US006016667A

United States Patent [19]

Doerler et al.

[11] Patent Number: 6,016,667

[45] Date of Patent: Jan. 25, 2000

[54] PROCESS FOR DEGASOLINING A GAS CONTAINING CONDENSABLE HYDROCARBONS

[75] Inventors: Nicole Doerler, Nanterre; Alexandre Rojey; Etienne Lebas, both of Rueil Malmaison, all of France

[73] Assignee: Institut Francais du Petrole, Rueil Malmaison Cedex, France

[21] Appl. No.: 09/098,638

[22] Filed: Jun. 17, 1998

[30] Foreign Application Priority Data

Jun. 17, 1997 [FR] France ..... 97-07612

[51] Int. Cl.[7] ..... F25J 3/00

[52] U.S. Cl. ..... 62/625; 62/633

[58] Field of Search ..... 62/625, 620, 618, 62/631, 632, 633

[56] References Cited

U.S. PATENT DOCUMENTS

| | | | |
|---|---|---|---|
| 3,633,338 | 1/1972 | Zahn . | |
| 3,676,981 | 7/1972 | Afdahl et al. . | |
| 3,925,047 | 12/1975 | Harper | 62/633 |
| 4,070,165 | 1/1978 | Colton . | |
| 4,150,962 | 4/1979 | Colton | 62/630 |
| 4,266,958 | 5/1981 | Cummings | 62/633 |
| 5,127,231 | 7/1992 | Larue et al. | 62/633 |
| 5,868,005 | 2/1999 | Larue et al. | 62/625 |

*Primary Examiner*—William Doerrler
*Attorney, Agent, or Firm*—Millen, White, Zelano & Branigan, P.C.

[57] ABSTRACT

Described is a process for degasolining by refrigeration of a gas containing condensable hydrocarbons, which is effected in the presence of methanol to avoid the formation of hydrates, said process making it possible to at least partially recover the methanol entrained in the gas, by washing same by means of a liquid hydrocarbon fraction. The process described thus makes it possible to avoid having to compensate for the loss of methanol by a continuous make-up, as is the case with conventional processes. It accordingly enjoys enhanced levels of performance and economy.

19 Claims, 3 Drawing Sheets

PROCESS FOR DEGASOLINING A GAS CONTAINING CONDENSABLE HYDROCARBONS

FIELD OF THE INVENTION

The invention concerns a process for degasolining by refrigeration in the presence of methanol to avoid the formation of hydrates, making it possible to at least partially recover the methanol entrained in the treated gas.

BACKGROUND OF THE INVENTION

The invention is applied to natural gas as well as to other gases containing condensable hydrocarbons such as refinery gases. If a liquid hydrocarbon phase condenses in the course of transportation and/or handling of such gases, it runs the risk of giving rise to difficulties and mishaps such as the occurrence of liquid blockages in transport or processing installations designed for gaseous effluents.

In order to avoid such problems the gases containing condensable hydrocarbons are generally subjected to a degasolining treatment prior to transportation thereof.

The prime function of that step is to adjust the hydrocarbon dew point to avoid the condensation of a hydrocarbon fraction in the course of transportation of the gas. When treating natural gas the degasolining operation can be used to adjust the calorific value of the gas to the commercial standards which are fixed on the distribution networks. The degasolining operation effected to adjust the calorific value of a gas generally involves fractionation to a more advanced degree than simple adjustment of the dew point for transportation purposes. Finally degasolining can be effected to recover the liquefied natural gas fraction (LNG) comprising the LPG fraction and the gasoline fraction ($C_{5+}$) which can be better put to use than the treated gas.

Various degasolining processes based on the use of refrigeration, absorption or adsorption are described in the prior art. Processes making use of refrigeration of the gas are by far the most widely used. The gas can be refrigerated either by virtue of expansion through a valve or through a turbine, or by an external cooling cycle, which makes it possible to lower the temperature of the gas to be treated without reducing the pressure thereof.

The presence of water in the gas to be treated gives rise to the risk of the formation of hydrates. That risk can be avoided by injecting a hydrate-formation inhibitor into the gas. When a glycol is used as the inhibitor the refrigeration operation makes it possible simultaneously to obtain a condensate and an aqueous phase composed of a mixture of water and inhibitor. The glycol can be regenerated by distillation. That regeneration operation can however become highly expensive when the amounts of water involved are high and in particular in the presence of free water.

Operators frequently prefer to use methanol as the hydrates inhibitor. That alcohol is less expensive than glycols. In addition it is easier to use as it is less viscous. That inhibitor is generally not recycled. Methanol has a lower vapour pressure than glycols and it is partially soluble in the condensates. After refrigeration a not inconsiderable amount of methanol is contained in the treated gas and in the two condensed phases.

SUMMARY OF THE INVENTION

The present invention concerns a process for degasolining by refrigeration in the presence of methanol for avoiding the formation of hydrates, making it possible to at least partially recover the methanol contained in the treated gas.

That process makes it possible to successfully implement a degasolining step while achieving a notable degree of economy, by virtue of the smaller amount of methanol consumed and the reduction in associated costs: supplying, transportation and storage.

The process according to the invention is based on the use of an operation of washing the gas by means of a fraction of the condensed hydrocarbon phase.

In accordance with a first embodiment of the process according to the invention the hydrocarbon phase used for washing the gas is produced in the course of the degasolining operation. In that case the condensed hydrocarbon phase contains methanol. It has to be for example subjected to a washing operation with water before being used for the operation of washing the gas.

In this first embodiment the process can be defined by virtue of comprising the following steps:

a) The gas is degasolined by refrigeration. Methanol is injected upstream of the refrigeration unit to avoid the risks of hydrates being formed.

b) The fluid which is partially condensed in the course of the refrigeration step is passed into a three-phase separator. The liquid hydrocarbon and aqueous phases are separated by settlement in the separator. The aqueous phase is evacuated.

c) The liquid hydrocarbon phase is passed into a stabilisation column in order to separate the more volatile components (methane and ethane) from said liquid hydrocarbon fraction.

d) The gaseous fraction issuing at the head of the stabilisation column can be used as fuel gas (1), or re-compressed to be recycled upstream of the separation step (2), or again mixed with the treated gas (3).

e) The hydrocarbon phase comprising the constituents of higher molecular mass than that of ethane and issuing at the bottom of the stabilisation column is passed into a washing zone using water in order to eliminate the methanol that it contains.

f) A fraction of the washed hydrocarbon phase is passed to the head of a washing column in which it is brought into contact with the gas containing methanol issuing from the separation step or a gaseous mixture of said gas and the gas issuing from the stabilisation step if option (2) is applied in step (d).

g) In the course of the contact step the methanol passes from the gaseous hydrocarbon phase to the liquid hydrocarbon fraction. The treated gas from which the methanol that it contained has been at least partially removed is discharged at the head of the contact zone. The liquid hydrocarbon fraction which is charged with methanol and evacuated at the bottom of the contact zone is mixed with the liquid hydrocarbon fraction from step (b), then passed to the stabilisation step.

DETAILED DESCRIPTION OF DRAWINGS

Figure 1:
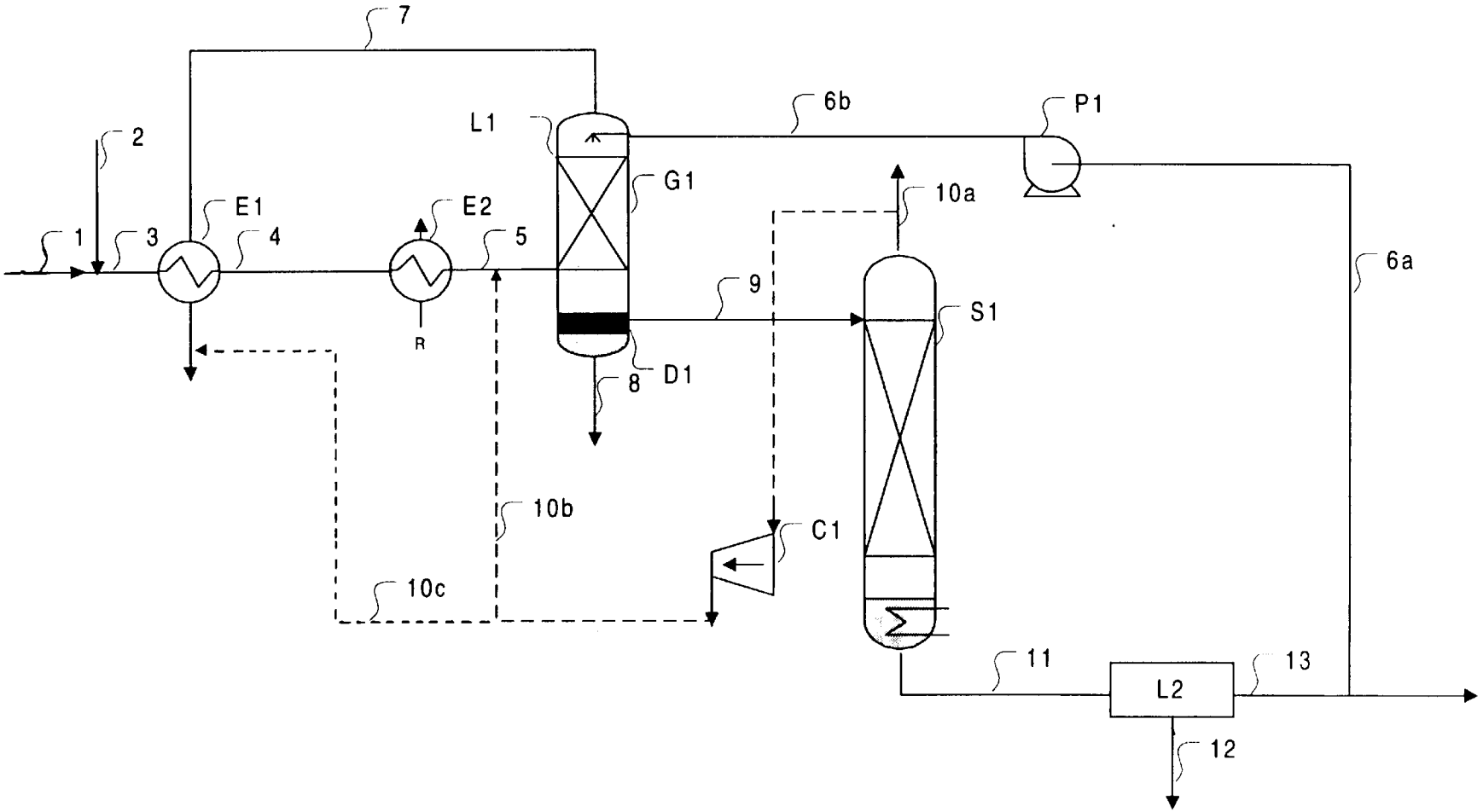
FIGS. 1–3 are schematic flowcharts of different embodiments of the invention.

This first embodiment of the process of the invention is illustrated by FIG. 1 and can be described as follows.

The natural gas to be treated arrives by way of the conduit 1. The gas receives a make-up amount of methanol by way of the conduit 2 and is then passed by way of the conduit 3 into a heat exchanger E1 in which it is cooled. All or part of the treated gas which passes by way of the conduit 7 can be used as a cooling fluid in the heat exchanger E1.

The gas, or the gas and the phases which are condensed in the heat exchanger E1, are passed to a refrigeration step E2 by way of the conduit 4. Refrigeration can be effected by expansion of the gas through a valve or through a turbine, by means of an external cold cycle or by means of any other solution which is known to the man skilled in the art. The different phases issuing from that gas refrigeration step are passed into a washing column L1 by way of the conduit 5. That column contains a contact zone G1 which is formed for example by a filled section and a settlement zone D1. In the washing column L1 the gas which is charged with methanol is brought into contact with a fraction of the stabilised and washed condensate, which is injected at the head of the contact zone.

That liquid hydrocarbon fraction which is taken off by way of the conduit 6*a* downstream of the process is passed by means of the pump P1 into the washing column L1 by way of the conduit 6*b*.

In the course of the contact step which is implemented in the zone G1 the methanol which is more highly soluble in liquid than gaseous hydrocarbons is absorbed, all or partly, in the condensate. The treated gas from which methanol has been removed issues at the head of the column L1 by way of the conduit 7.

At the bottom of the column L1 two liquid phases are separated by settlement: an aqueous phase formed of water and methanol which is discharged from the process by way of the conduit 8, and a liquid hydrocarbon fraction which is made up of the mixture of the hydrocarbon phase condensed in the course of the refrigeration step E2 and the hydrocarbon phase which is passed by way of the conduit 6*b* for washing of the gas.

The liquid hydrocarbon phase is passed by way of the conduit 9 into a stabilisation column S1. The following issue from that column: a liquid hydrocarbon fraction which has been freed of the major part of the lighter constituents that it contains (methane and ethane), which is passed into a washing unit L2 by way of the conduit 11, and a gaseous fraction which can be used for example as a fuel gas on the production site (that option is represented by the conduit 10*a* in FIG. 1) or re-compressed with the compressor C1 and then recycled to the process upstream of the column L1 by way of the conduit 10*b* or mixed with the gas treated by way of the conduit 10*c*.

The washing unit L2 may be formed for example by one or more static mixers or a column operating in counter-flow relationship such as a filled column. In that unit the liquid hydrocarbon fraction containing methanol is brought into contact with pure water or water containing substantially less methanol than the hydrocarbon phase. At the end of that contact the methanol which is more soluble in the water than in the hydrocarbons is discharged from the washing unit in the form of an aqueous phase by way of the conduit 12. The liquid hydrocarbon fraction is discharged by the conduit 13 to be exported.

The first embodiment of the process of the invention as described hereinbefore is illustrated by following Example 1 which is described with reference to FIG. 1.

EXAMPLE 1

Consideration is directed to a natural gas which is saturated with water, of which the pressure is 6.7 MPa and the temperature is 43° C., and the composition of which is set out in Table 1. Its flow rate is 23.25 tons per hour, which corresponds to a production of about 0.6 $Mm^3$ (standard)/day.

TABLE 1

| Composition | Molar % |
|---|---|
| $N_2$ | 1.2 |
| $CO_2$ | 1.5 |
| Methane | 85.0 |
| Ethane | 7.5 |
| Propane | 3.0 |
| Butane | 1.2 |
| Pentane | 0.4 |
| $C_{6+}$ | 0.2 |

In this Example the gas produced receives a make-up amount of methanol of 75 kg/hour by way of the conduit 2 and is then passed towards the heat exchanger E1. The fluid used for cooling purposes in that heat exchanger is the treated gas which arrives at the heat exchanger by way of the conduit 7.

At the outlet from that heat exchanger the temperature of the partially condensed gas is −10° C. The different phases issuing from the condensation operation are again cooled to a temperature of −26° C. by an external refrigeration cycle E2.

At the end of the refrigeration step the three phases passed to the contact zone L1 comprise:

- a liquid aqueous phase containing 50 molar % of methanol at a flow rate of 100 kg/hour;
- a condensed liquid hydrocarbon fraction containing 2,600 molar ppm of methanol; and
- a flow rate of 22.8 tons/hour of gas to be treated containing 125 molar ppm of methanol, to which there is added a flow rate of 1.8 ton/hour of recycled gas coming from the stabilisation step S1 by way of the conduit 10*b*.

Those three phases are injected into the column L1 by way of the conduit 5. The operation of that column is substantially isothermal and isobaric.

The contact zone G1 of that column contains a structured filling height corresponding to three theoretical stages. The gas issuing from the conduit 5 is brought into contact in that zone with a stabilised and washed liquid hydrocarbon fraction which is injected at the head of the column L1 by way of the conduit 6*b*. A flow rate of 1.2 ton/hour of liquid hydrocarbon is necessary to eliminate the methanol contained in the gas. At the outlet from the column L1 the concentration of methanol in the treated gas, which is discharged by way of the conduit 7, is 5 molar ppm.

The liquid aqueous and hydrocarbon phases are separated by settlement in the part D1 of the column L1. The aqueous phase is removed from the process by way of the conduit 8.

The liquid hydrocarbon fraction is composed of the condensates issuing from the refrigeration step and the liquid hydrocarbon fraction which was used to wash the gas. That mixture is passed to the stabilisation column S1 by way of the conduit 9. In this example the gas issuing from the stabilisation column is recompressed and then recycled upstream of the washing column L1 by way of the conduit 10*b*.

The liquid hydrocarbon fraction essentially containing the $C_{3+}$ constituents is passed by way of the conduit 11 to a washing step L2. In this example the washing operation is effected in a filled column by contact between the hydrocarbon phase and pure water. After that washing operation the concentration of methanol in the condensed hydrocarbon phase is less than 50 molar ppm. The water which is charged with methanol and the liquid hydrocarbon fraction are respectively discharged by way of the conduits 12 and 13.

In a second embodiment of the process according to the invention the liquid hydrocarbon phase which is used to remove from the gas the methanol that it contains comes from a condensation step prior to the degasolining step.

In this case the process according to the invention can be defined as comprising the following steps:

a) The gas to be treated is divided into two fractions (1) and (2).

b) Said fraction (1) is cooled. That cooling causes condensation of a liquid aqueous phase and a liquid phase of higher hydrocarbons.

c) In a three-phase separator, the phases issuing from the cooling step (b) are separated, with the water of condensation being discharged.

d) The fraction (2) of gas to be treated issuing from the separation step (a) is brought into contact with an aqueous phase containing methanol. In the contact zone the methanol contained in the aqueous phase is extracted by the gas. At the discharge from that step the gas is charged with methanol while the aqueous phase from which practically all of the methanol that it contained has been removed is discharged at the base of the contact zone.

e) The gaseous phases issuing from steps (c) and (d) are mixed and refrigerated after having received a make-up amount of methanol.

f) The three phases issuing from step (e) which are formed by the residual aqueous phase, the liquid hydrocarbon phase and the gaseous phase are passed into a column in which washing of the gas and settlement of the liquid phases take place. The operation of washing the gas is effected by bringing the gas into contact in counter-flow relationship with the condensate which is free of methanol, issuing from the separation stage (c). In the course of that contact step the methanol goes from the gaseous phase to the liquid hydrocarbon fraction. The gas to be treated from which the methanol that it contained has been removed is discharged. The liquid aqueous and hydrocarbon phases are separated by settlement in the lower zone of the column.

g) The liquid hydrocarbon fraction is passed into a stabilisation column in which the lighter components (methane and ethane) are separated.

h) The gaseous fraction issuing at the head of the stabilisation column can be used as fuel gas or recompressed to be recycled downstream of the separation step or again mixed with the treated gas.

i) The hydrocarbon phase issuing at the bottom of the stabilisation column is discharged to be exported.

j) The aqueous phase charged with methanol, issuing from settlement step (f), is recycled to the head of the contact zone (d).

Figure 2:
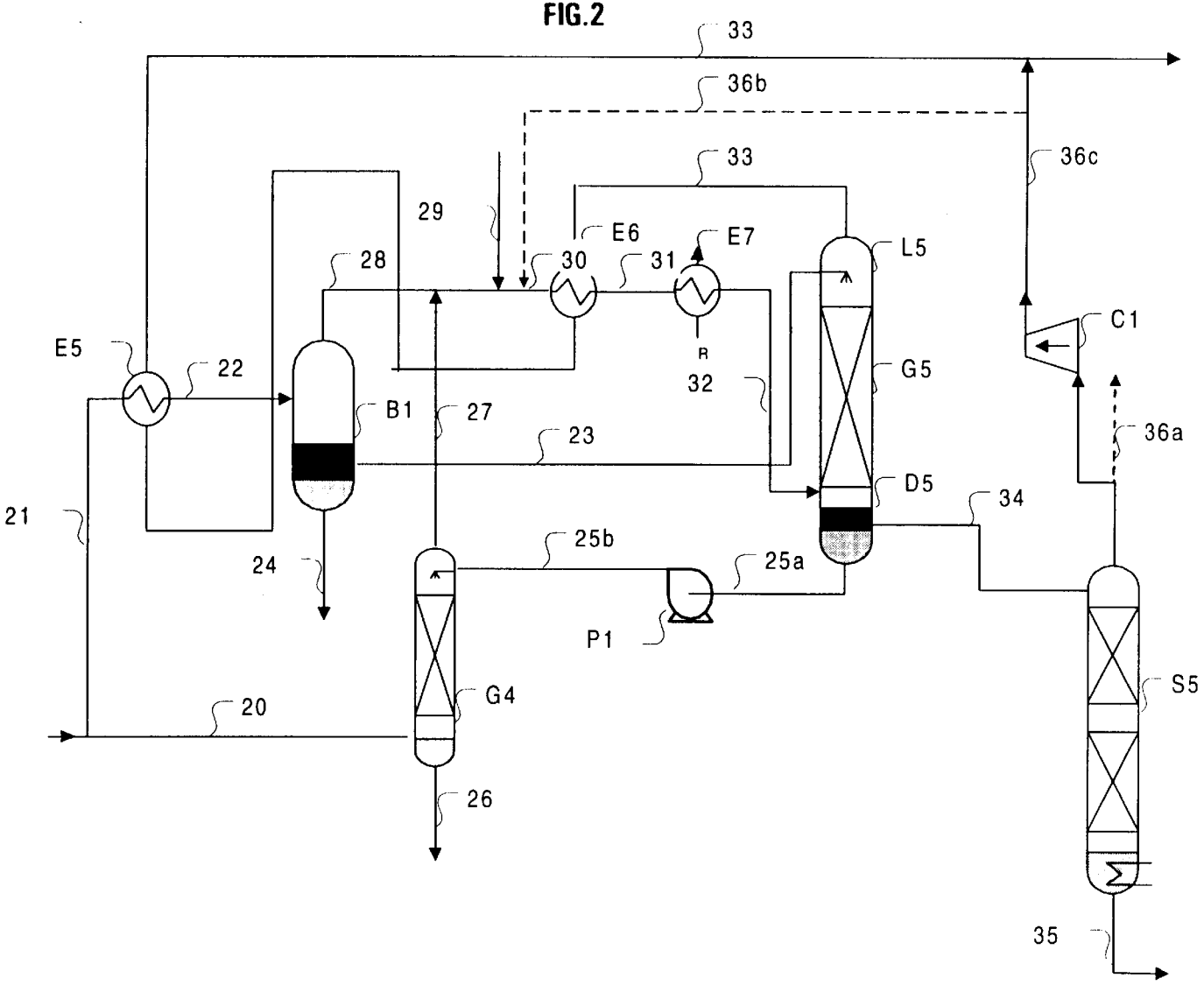

This embodiment which is illustrated in FIG. 2 is described in greater detail hereinafter.

The gas to be treated is divided into two fractions passing by way of the conduits 20 and 21. The fraction of the gas which goes by way of the conduit 21 is cooled by means of a heat exchanger E5. At the outlet from that heat exchanger the temperature of the gas is close to but higher than the temperature for formation of hydrates in the gas to be treated. The cooling fluid used in that heat exchanger may be a cooling fluid which is available on the installation, for example air or water, or all or part of the refrigerated gas issuing from the column L5 by way of the conduit 33.

The partially condensed fluid obtained in that way is passed by way of the conduit 22 into a three-phase separation balloon flask B1. The water and the liquid hydrocarbon phase condensed in the course of the cooling step E5 are separated by settlement. It is to be noted that those two fluids are free from methanol. The liquid hydrocarbon fraction is discharged from the three-phase separation balloon flask by way of the conduit 23. The water is discharged from the process by way of the conduit 24.

The second fraction of the gas which goes by way of the conduit 20 is passed into the contact zone G4 in which it is brought into contact with a recycled aqueous phase charged with methanol, injected at the head of the contact zone by way of the conduit 25*b*. In the course of that contact the methanol is desorbed from the aqueous phase by the gas. The aqueous phase which is at least partially freed of the solvent that it contained is discharged at the bottom of the contact zone G4 by way of the conduit 26 and the gas charged with methanol is discharged at the head of the contact zone G4 by way of the conduit 27.

The gas issuing from the three-phase separation balloon flask B1 by way of the conduit 28 is mixed with the gas charged with solvent issuing from the contact zone. A make-up amount of methanol is added to the gaseous mixture by way of the conduit 29. The magnitude of that make-up amount is controlled in order to produce in the gas a level of concentration such that any risk linked to the formation of hydrates is avoided in the course of the subsequent refrigeration steps, while compensating for the losses of solvent in the treated gas and in the liquid fractions.

The gaseous mixture charged with methanol which is obtained in that way is passed by way of the conduit 30 into the heat exchanger E6 in which it is cooled by heat exchange relationship preferably with the cold gas issuing from the column L5. Refrigeration is then continued in the exchanger E7, for example by means of a cold-producing fluid, in such a way as to attain the specifications relating to dew points in respect of water and/or hydrocarbons of the gas to be treated.

The liquid and gaseous phases issuing from the exchanger E7 by way of the conduit 32 are passed into a column L5 comprising a washing zone G5 which can be formed for example by a structured filling section and a settlement zone D5.

In the washing zone the gas charged with methanol is brought into contact with the liquid hydrocarbon fraction free from methanol which issued from the cooling step effected in the exchanger E5 and having settled in the balloon flask B1. That liquid fraction is injected into the column by way of the conduit 23.

In the course of that contact step the methanol is entirely or partially absorbed in the liquid hydrocarbon fraction. The treated gas which is practically free from methanol issues at the head of the column by way of the conduit 33.

At the bottom of the column L5 two liquid phases are separated by settlement: an aqueous phase formed of water and methanol which is drawn off by way of the conduit 25*a* and recycled by means of the pump P1 to the head of the contact zone G4 by way of the conduit 25*b*, and a liquid hydrocarbon phase which is composed of the mixture of the hydrocarbon phase condensed in the course of the refrigeration step implemented in the exchanger E7 and the hydrocarbon phase injected by way of the conduit 23 for washing the gas.

The liquid hydrocarbon phase is passed by way of the conduit 34 into a stabilisation column S5. The following issue from that column: a liquid hydrocarbon phase which has been freed of the major part of the lighter constituents that it contains (methane and ethane), being discharged by way of the conduit 35, and a gaseous phase which can be used for example as a fuel gas on site (conduit 36*a*) or recompressed by means of the compressor C1 and then recycled upstream of the refrigeration step E7 by way of the conduit 36*b* or yet again mixed with the treated gas by way of the conduit 36*c*.

This embodiment of the process according to the invention is illustrated by Example 2 with reference to FIG. 2.

EXAMPLE 2

The natural gas is produced under the conditions in respect of pressure, flow rate and composition as described in Example 1. The temperature of the gas at the well outlet is 65° C.

In this Example 85% of the gas produced is passed towards the heat exchanger E5 by way of the conduit 21. The temperature is 20° C. at the discharge from that heat exchanger. This first cooling step causes the condensation of:

78.5 kg/hour of water, and 1.2 ton/hour of condensate having a molecular mass of 55 g/mol.

This operation makes it possible to condense close to 75% of the water initially contained in the gas to be treated.

The residual gas fraction, namely 15% of the production, is passed by way of the conduit 20 to the contact zone G4. In this Example contact between the gas and an aqueous solution containing 50 molar % of methanol is effected in a column with structured filling. The aqueous phase issuing at the bottom of the column by way of the conduit 26 is practically freed of the solvent that it contained.

The gas charged with methanol issuing from the contact zone G4 by way of the conduit 27 is mixed with the gas issuing from the separator B1. That mixture receives a make-up amount of 16 kg/hour of methanol by way of the conduit 29. The flow rate of methanol injected is adjusted so as to compensate for the solvent losses of the process. That flow rate is substantially reduced in comparison with Example 1 as the volume of the aqueous phase which is condensed in the course of the refrigeration step is smaller and in addition the methanol which is solubilised in that condensed aqueous phase is recycled for the major part thereof.

The gas is cooled and then subjected to a refrigeration step at a temperature of −26° C. The different phases issuing from the refrigeration step are passed to the base of the column L5. The liquid hydrocarbon phase which is free of the methanol is passed to the head of the column in order to wash the gas in counter-flow relationship and to remove therefrom the methanol that it contains.

The gas issuing from the stabilisation column by way of the conduit 36*a* is recompressed by means of the compressor C1 and recycled by way of the conduit 36*c* to be mixed with the treated gas. The treated gas issuing from the process has a residual methanol content of 10 molar ppm.

The condensate issuing from the column L5 by way of the conduit 34 is passed to the stabilisation column S5.

The aqueous phase containing 50% of methanol issuing from the column by way of the conduit 25*a* is pumped by means of the pump P1 and recycled by means of the conduit 25*b* to the head of the contact zone G5.

A preferred variant of the process according to the invention makes it possible to reduce to the greatest possible degree the consumption of methanol necessary to avoid any risk of hydrates being formed in the course of the degasolining operation and to produce at the same time a gas and a condensate from which has been removed the methanol that they contained.

This variant of the process of the invention can then be defined as comprising the following steps:

a) The gas to be treated is divided into two fractions (1) and (2).

b) The fraction (1) is cooled. That cooling causes the condensation of water and a liquid hydrocarbon phase. The gas and the liquid phases which are condensed are separated in a three-phase separator.

c) The gas fraction (2) is divided into two fractions (2*a*) and (2*b*) which are passed into a column comprising two separate contact zones. The gas fraction (2*a*) is brought into contact with an aqueous phase charged with methanol and issuing from the refrigeration step (e) described hereinafter. In the course of that contact step the gas becomes charged with methanol. The aqueous phase from which has been removed the major part of the methanol that it contained is discharged. The gas fraction (2*b*) is brought into contact with an aqueous phase charged with methanol, issuing from the step involving washing of the condensates. In the course of that contact step the gas becomes charged with methanol. The aqueous phase which is at least partially freed of the methanol that it contained on issuing from that contact step is recycled towards the washing step.

d) The gaseous phases issuing from steps (b) and (c) are mixed and then refrigerated after having received a make-up amount of methanol.

e) The three phases issuing from the refrigeration step (d), which are formed by the residual aqueous phase charged with methanol, the liquid hydrocarbon fraction and the gaseous phase, are passed to the base of a column in which washing of the gas and settlement of the liquid phases take place. The operation of washing the gas is effected by bringing the gas into contact in counter-flow relationship with the condensate which is free of methanol, issuing from the cooling step (b). In the course of that contact step the methanol contained in the gaseous phase is absorbed by the liquid hydrocarbon fraction. The gas to be treated from which has been removed the methanol that it contained is discharged. The liquid phases are separated by settlement at the base of the column.

f) The aqueous phase charged with methanol is recycled to the contact step (c).

g) The liquid hydrocarbon fraction is passed into a stabilisation column in which the lightest constituents (methane and ethane) are separated from the liquid phase.

h) The gaseous fraction issuing from the stabilisation step can be used for example as fuel gas or recompressed to be recycled upstream of the refrigeration step (d).

i) The liquid hydrocarbon fraction issuing at the bottom of the stabilisation column is practically freed of the methanol that it contains by washing with water. The water used for the washing operation is regenerated and recycled by the contact step (c) with the gas fraction (2*b*). At the discharge from the washing operation the condensates are removed from the process.

Figure 3:
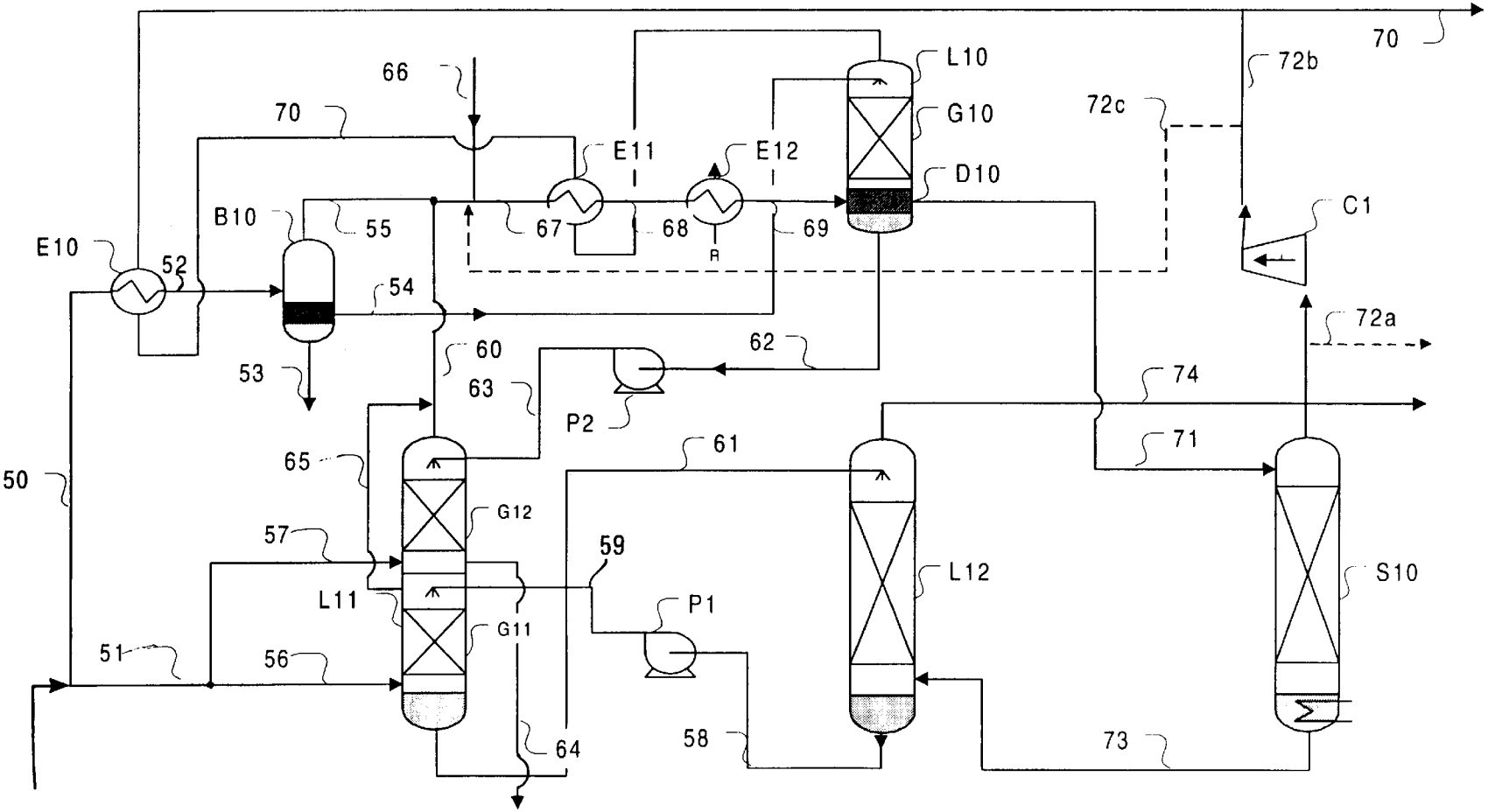

This variant of the process of the invention which is illustrated in FIG. 3 is described in greater detail hereinafter.

The natural gas to be treated is divided into two fractions which are passed into the conduits 50 and 51. The gas flowing in the conduit 50 is passed into a heat exchanger E10. All or part of the treated gas, passing by way of the conduit 70 can be used as a cooling fluid in the heat exchanger E10. Cooling of the gas to a temperature higher than the temperature at which hydrates are formed causes the condensation of water and a liquid hydrocarbon fraction. The different phases issuing from the refrigeration operation are passed into a three-phase separation balloon flask B10 by way of the conduit 52. The water of condensation is removed from the process by way of the conduit 53. The liquid hydrocarbon fraction is free of methanol. It is passed by way of the conduit 54 to the head of the washing column L10.

The second fraction of the gas which flows through the conduit 51 is again divided into two fractions which are passed by way of conduits 56 and 57 into a column L11 comprising two separate contact zones G11 and G12. Those contact zones can be formed for example by elements of structured fillings. The gas which is passed by way of the conduit 56 to the base of the contact zone G11 is brought into contact in counter-flow relationship with the aqueous phase containing methanol, which issues from the unit for washing the stabilised condensates L12. That phase issues from the washing zone by way of the conduit 58, and is then passed by means of the pump P1 by way of the conduit 59 into the zone G11. The gas is charged with methanol in the course of that contact step. It issues from the contact zone by way of the conduit 65. The aqueous phase which is at least partially freed of the methanol that it contained is recycled to the washing unit L12 by way of the conduit 61.

The gas which is passed by way of the conduit 57 to the base of the contact zone G12 is brought into contact in counter-flow relationship with an aqueous phase which is heavily charged with methanol, coming from the washing column L10. The aqueous phase issuing from the column L10 by way of the conduit 62 is passed by means of the pump P2 by way of the conduit 63 to the head of the zone G12. The gas is charged with methanol in the course of that contact step. The flow rate of gas which is passed into the contact zone and the height of the contact zone are adjusted in order to achieve exhaustion of the aqueous phase. At the end of the contact operation the aqueous phase now containing nothing more than traces of methanol is discharged by way of the conduit 64. The gaseous phase issuing from the contact zone by way of the conduit 60 is mixed with the gas issuing from the contact zone G11 by way of the conduit 65 and then with the gas issuing from the three-phase separation balloon flask B10 by way of the conduit 55. A make-up amount of methanol is added to the gas to be treated by way of the conduit 66. The gaseous mixture which is charged with methanol is passed by way of the conduit 67 into the heat exchanger E11 in which it is cooled preferably by heat exchange with the treated gas issuing from the column L10 by way of the conduit 70. Refrigeration is continued in the heat exchanger E12 by means for example of a cold-producing fluid in such a way as to attain the specifications relating to dew points in respect of water and/or hydrocarbons of the gas to be treated. The different phases issuing from the refrigeration operation are passed by way of the conduit 69 into the column L10 which effects the functions of washing the gas, in the contact zone G10, and separation of the liquid phases by settlement in the zone D10.

In the contact zone G10 the gas which is degasolined and dehydrated on issuing from the refrigeration step is brought into contact with the liquid hydrocarbon fraction free from methanol issuing from the cooling step effected in the heat exchanger E10. The result obtained at the discharge from that contact step is a treated gas which now contains nothing more than traces of methanol and which is discharged by way of the conduit 70, and a liquid hydrocarbon fraction charged with methanol which is mixed with the liquid hydrocarbon fraction condensed in the course of the refrigeration step effected in the heat exchanger E12.

The settlement zone D10 makes it possible to separate the liquid hydrocarbon fraction described hereinbefore from the aqueous phase charged with methanol, which issues from the refrigeration step E12. That aqueous phase is recycled by means of the pump P2 into the contact zone G1 by way of the conduit 63.

The liquid hydrocarbon fraction is passed to a stabilisation column S10 by way of the conduit 71. In the course of that step the condensates are freed of the lightest constituents (methane and ethane). The gas issuing from S10 by way of the column 72*a* can be used for example as a fuel gas or recompressed by means of the compressor C1 and mixed with the treated gas by way of the conduit 72*b* or yet again recycled upstream of the refrigeration step E11 by way of the conduit 72*c*.

The stabilised liquid hydrocarbon fraction discharged from the column S10 by way of the conduit 73 is passed to the head of the washing zone L12. In FIG. 3 the washing zone is indicated by a counter-flow column receiving the washing water by way of the conduit 61. The use of other items of equipment can be envisaged, for example one or more static mixers. Methanol is more highly soluble in water than the condensates. At the discharge from the washing step the methanol-rich aqueous phase is recycled to the contact zone G11 by way of the conduit 59 and the stabilised and washed condensates are discharged by way of the conduit 74.

This variant of the process according to the invention is illustrated by following Example 3.

EXAMPLE 3

The gas to be treated is produced under the conditions described in Example 2. The gas is treated in accordance with the diagrammatic view shown in FIG. 3.

Half of the gas to be treated is passed into the heat exchanger E10. When it issues from that heat exchanger its temperature is 20° C. The gas and the liquid phases resulting from the condensation operation are separated in a three-phase balloon flask B10. The water of condensation is discharged by way of the conduit 53. A flow rate of 1.2 ton/hour of liquid hydrocarbon fraction which is condensed in the course of that cooling step is passed into a washing column L10 in which it is brought into contact with the refrigerated gas in counter-flow relationship.

The second fraction of the gas to be treated is again divided into two fractions corresponding to 15 and 35% of the gas produced. Those fractions are respectively passed by way of the conduits 57 and 56 into the contact zones G12 and G11 of the column L11. In the zone G12 the gas is brought into contact in counter-flow relationship with the gaseous phase which is condensed in the course of the refrigeration step, which is recycled to the contact zone G12 by means of the pump P2. On issuing from that contact step the water which has been freed of the methanol that it contained is discharged by way of the conduit 64. The cumulative flow rate discharged by way of the conduits 53 and 64 approximately corresponds to the amount present in the saturated gas at the entry to the process (that is to say a flow rate by mass of 100 kg per hour).

In the contact zone G11 the gas is brought into contact in counter-flow relationship with the aqueous phase charged with methanol, issuing from the column L12 after washing of the condensates and recycled by the pump P1.

The three gaseous fractions from the three-phase separation balloon flask and the contact zones G11 and G12 are mixed and receive a make-up amount of methanol which in this Example is very small, being less than 3 kg/hour, the major part of the solvent being recycled. The resulting gaseous mixture is subjected to a refrigeration step at −26° C. The result obtained at the outlet of that refrigeration step is an aqueous phase having a methanol content of 50 molar % which is recycled to the contact zone G12, a flow rate of 20 tons/hour of gas and a liquid hydrocarbon fraction containing 5,000 molar ppm of methanol. Those three phases are passed to the base of the column L10. On entering the column L10 that gas contains 90 molar ppm of methanol. It is brought into contact with a flow rate of 1.2 ton/hour of liquid hydrocarbon phase which is free of methanol, issuing from the balloon flask B10. On issuing from that contact step the residual content of methanol in the treated gas discharged by way of the conduit 70 is 10 molar ppm.

The liquid hydrocarbon fraction which has served for the operation of washing the gas, on issuing from the column L10, is passed by way of the conduit 71 to the stabilisation column S10. The gaseous phase issuing from that stabilisation step is in this Example recompressed and mixed with the treated gas.

The condensate from the stabilisation column is then washed in the washing zone. This Example involves the use of a filled column in which the water and the condensate flow in counter-flow relationship. This type of equipment makes it possible to attain a degree of recovery of the methanol of higher than 99%. At the end of the washing operation the liquid hydrocarbon fraction contains less than 50 molar ppm of methanol.

Various other arrangements can be adopted without thereby departing from the scope of the present invention.

The operation of washing the liquid hydrocarbon fraction by means of the aqueous phase can be effected in one or more mixer-settler units.

It can also be implemented in a column operating in counter-flow relationship, which for example may be a filled column. Different types of filling may be used, for example a structured filling. It is also possible to use a plate-type column.

Recovery of the methanol contained in the liquid hydrocarbon fraction can be effected by procedures other than washing with water. Separation as between the methanol and the liquid hydrocarbon fraction can be effected for example by pervaporation through a membrane which is selective in respect of methanol.

Recovery of the methanol can also be effected by adsorption of the methanol on a suitable molecular sieve. In that configuration, two beds of adsorption agent operate simultaneously, the first in a mode involving adsorption of the methanol by contact with the liquid hydrocarbon fraction which circulates therein, and the second in a mode involving regeneration thereof. Regeneration is effected by sweeping the saturated bed with a fraction of the charge gas which provides for desorption of the methanol.

The heat exchangers used in the process may be of different types, for example of the type comprising tubes and a grill, or of the type comprising exchangers with plates, for example exchangers with plates of brazed aluminium.

The foregoing Examples can be repeated with similar results by substituting the general or particular reactants and/or conditions described in the invention for those used in those Examples.

In the light of the foregoing description the man skilled in the art can easily determine the essential features of the invention and, without departing from the spirit and scope thereof, can make various changes or modifications therein to adapt it to various uses and conditions of execution.

We claim:

1. A process of degasolining and dehydrating a charge of a hydrocarbon gas containing $H_2O$, a gasoline fraction and a $C_{1-4}$ hydrocarbon fraction, comprising the steps of:

a) adding methanol to said gas;

b) refrigerating the gas to condense a liquid aqueous phase containing methanol, a hydrocarbon liquid phase containing methanol and a degasolined gas phase;

c) separating said three phases in a triphasic separating zone;

d) passing the separated liquid hydrocarbon phase containing methanol into a stabilization zone so as to separate a light gas fraction methane and ethane at the top of said zone and to discharge a hydrocarbon liquid phase containing methanol at the bottom of said stabilization zone;

e) separating methanol from the discharged hydrocarbon containing methanol liquid phase and recovering said hydrocarbon liquid phase as gasoline;

f) contacting said degasolined gas phase with a hydrocarbon liquid fraction to recover methanol from said gas phase; and g) passing the resultant hydrocarbon liquid fraction containing methanol to said stabilization zone.

2. A process according to claim 1, characterised in that the methanol is at least partially separated from the methanol-containing liquid hydrocarbon phase by washing with water.

3. A process according to claim 2 characterised in that the operation of washing with water is effected in counter-flow relationship in a packed column.

4. A process according to claim 2 characterised in that the washing water is at least partially regenerated by contact with at least a fraction of the charging gas.

5. A process according to claim 1 characterised in that the methanol is at least partially separated from the methanol-containing liquid hydrocarbon phase by pervaporation.

6. A process according to claim 1 characterised in that the methanol is at least partially separated from the methanol-containing liquid hydrocarbon phase by an adsorption step, the adsorption agent being regenerated by contact with a fraction of the charging gas.

7. A process according to claim 1 characterised in that the liquid hydrocarbon fraction serving to wash the gas comes from a condensation step prior to the degasolining step.

8. A process according to claim 7 characterised in that it comprises the following steps:

a) the gas to be treated is divided into two fractions (1) and (2);

b) said fraction (1) is refrigerated, condensing a liquid aqueous phase and a liquid hydrocarbon phase;

c) the phases issuing from the refrigeration step (b) are separated in a three-phase separator, the water of condensation being discharged;

d) said fraction (2) of gas to be treated issuing from the separation step (a) is brought into contact with an aqueous phase comprising methanol, the hydrocarbon phase methanol contained in the aqueous phase being desorbed by the gas, said step producing the gas charged with methanol and the aqueous phase discharged at the base of the contact zone in a condition of being largely freed of the methanol that it contained;

e) the gaseous phases issuing from steps (c) and (d) are mixed and they are refrigerated after a make-up amount of methanol is added;

f) the three phases issuing from the refrigeration operation which are formed by the residual aqueous phase, the liquid hydrocarbon fraction and the gaseous phase are passed into a contact zone in which washing of the gas and settlement of the liquid phases takes place, washing of the gas being effected by bringing the gas into contact in counter-flow relationship with the condensate freed of methanol issuing from the separation step (c), the methanol going in the course of said contact from the gaseous phase to the liquid hydrocarbon fraction, the treated gas freed of the methanol that it contained being discharged and the liquid aqueous and hydrocarbon phases being separated by settlement in the lower part of the contact zone;

g) the liquid hydrocarbon fraction is passed into a stabilisation zone in which the lightest components (methane and ethane) are separated;

h) the gaseous fraction issuing at the head of the stabilisation column is used as a fuel gas; or it is recompressed before being recycled downstream of the separation step; or it is mixed with the treated gas;

i) the hydrocarbon phase issuing at the bottom of the stabilisation column is discharged; and j) the aqueous phase charged with methanol issuing from the settlement step (f) is recycled to the head of the contact zone (d).

9. A process according to claim 1 characterised in that the gas being treated is a natural gas.

10. A process according to claim 1 characterised in that the gas being treated is a refinery gas.

11. A process according to claim 8, characterised in that the gas being treated is a natural gas.

12. A process according to claim 8, characterised in that the gas being treated is a refinery gas.

13. A process according to claim 1, wherein said hydrocarbon liquid phase constituting the gasoline is recycled to step f) of contacting the degasolined gas so as to remove methanol therefrom.

14. A process according to claim 1, wherein said degasolined gas phase is contacted with a liquid hydrocarbon phase recovered from condensing a fraction of the charge gas, so as to remove methanol from said degasolined gas phase.

15. A process according to claim 1, further comprising recovering methanol from the liquid aqueous phase separated in the triphasic separated zone, comprising passing said liquid aqueous phase containing methanol in contact with a fraction of the charge gas and merging the resultant methanol enriched charge gas with the charge gas upstream of the refrigeration step.

16. A process according to claim 1, further comprising passing the separated degasolined gas stream in indirect heat exchange with at least a fraction of the charge gas, so as to cool said charge gas.

17. A process according to claim 1, further comprising recovering the light gas fraction separated from the head of the stabilization zone and passing said light gas fraction into a fuel gas distribution system.

18. A process according to claim 1, further comprising recompressing the light gas fraction separated from the head of the stabilization zone and recycling the resultant compressed gas fraction to the charge gas upstream of the refrigeration step.

19. A process according to claim 1, further comprising mixing the light gas fraction separated from the head of the stabilization zone with the separated degasolined gas phase from the refrigeration step.

* * * * *